United States Patent [19]

Gerhart

[11] Patent Number: 4,460,312

[45] Date of Patent: Jul. 17, 1984

[54] FAN UNIT

[75] Inventor: Roland T. Gerhart, Milford Township, Oakland County, Mich.

[73] Assignee: IEM Ltd., Novi, Mich.

[21] Appl. No.: 381,244

[22] Filed: May 24, 1982

Related U.S. Application Data

[63] Continuation-in-part of Ser. No. 138,811, Apr. 9, 1980, abandoned.

[51] Int. Cl.[3] ..... F04D 7/00

[52] U.S. Cl. ..... 415/207; 415/213 C; 415/219 R

[58] Field of Search ..... 415/207, 213 C, 213 R, 415/219 R, 219 C, 208, 209, 213 T

[56] References Cited

U.S. PATENT DOCUMENTS

| | | | |
|---|---|---|---|
| 2,231,258 | 2/1941 | Elmore | 237/51 |
| 2,976,352 | 3/1961 | Atalla | 415/213 R X |
| 3,531,221 | 9/1970 | Herberg et al. | 415/213 R X |
| 3,575,524 | 4/1971 | Adajain | 415/213 R |
| 3,635,285 | 1/1972 | Davis | 415/213 C UX |
| 3,942,509 | 3/1976 | Sasser | 126/121 |
| 4,085,727 | 4/1978 | Gillpatrick | 126/121 |
| 4,089,320 | 5/1978 | Brown et al. | 126/121 |
| 4,170,219 | 10/1979 | Hansen et al. | 126/121 |
| 4,174,701 | 11/1979 | Gneiting | 126/121 |
| 4,224,921 | 9/1980 | Petrescue | 126/121 |
| 4,259,510 | 2/1981 | Anderson | 126/121 |
| 4,280,473 | 7/1981 | Hempel | 126/121 X |

FOREIGN PATENT DOCUMENTS

| | | | |
|---|---|---|---|
| 844348 | 8/1960 | United Kingdom | 126/121 |

*Primary Examiner*—Stephen Marcus
*Assistant Examiner*—Joseph M. Pitko
*Attorney, Agent, or Firm*—Flynn, Thiel, Boutell & Tanis

[57] ABSTRACT

A fireplace unit provided with a fan below the bottom wall of the fire box for circulating room air around the fire box.

17 Claims, 12 Drawing Figures

FIG. 9
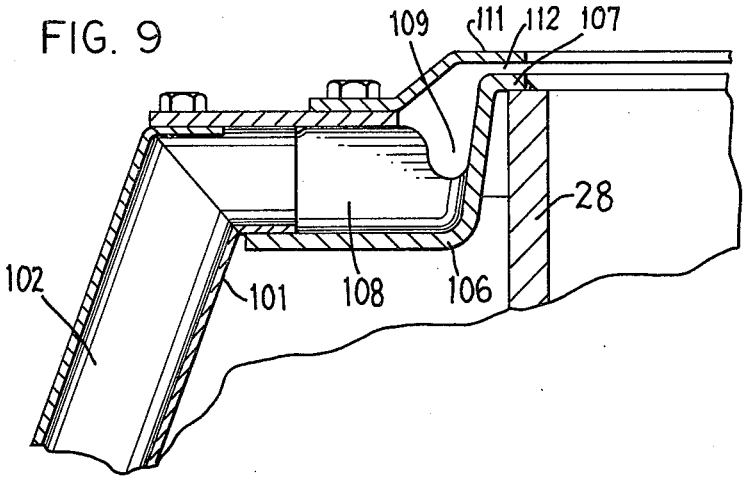
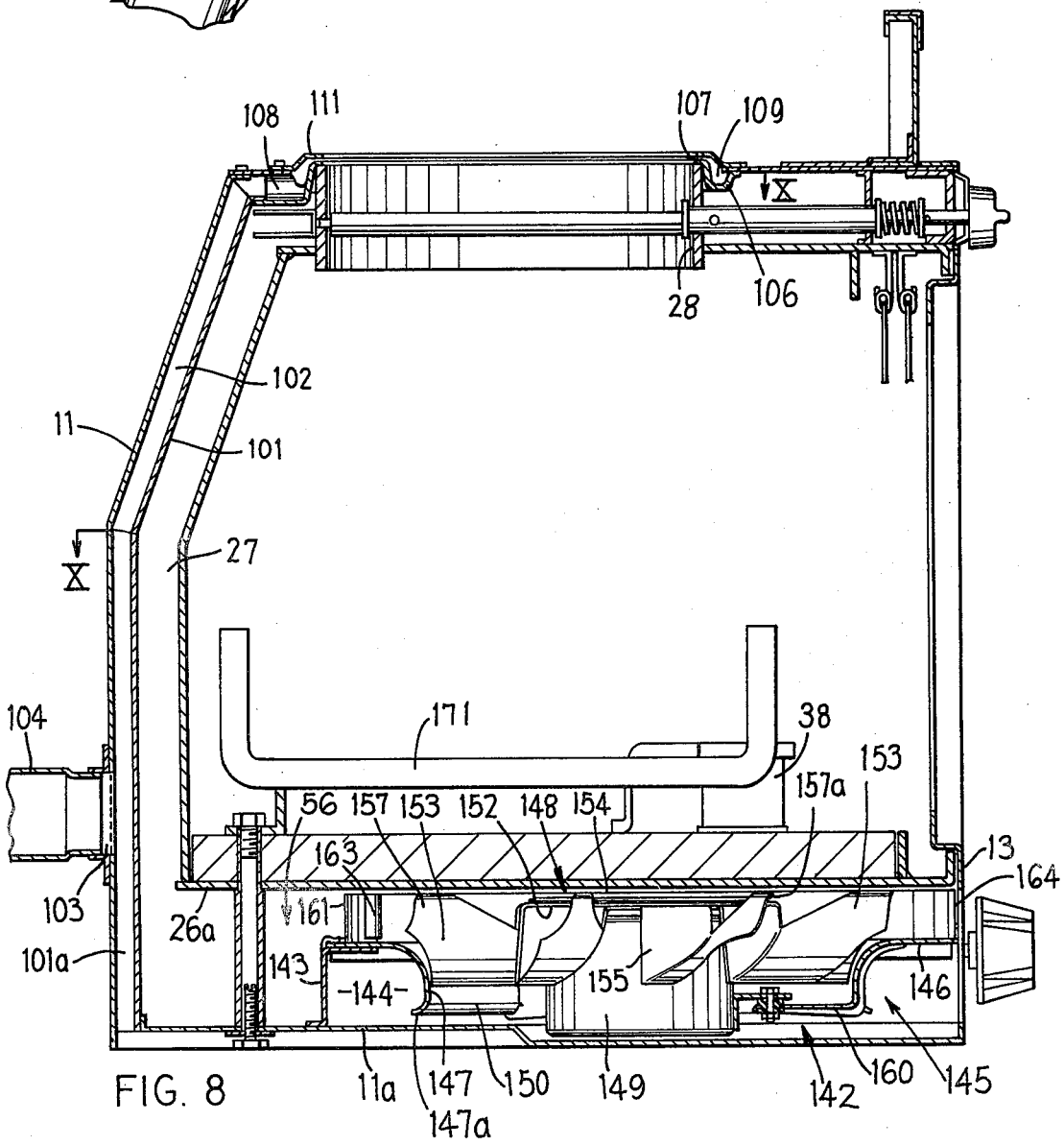
FIG. 8

FIG. 10
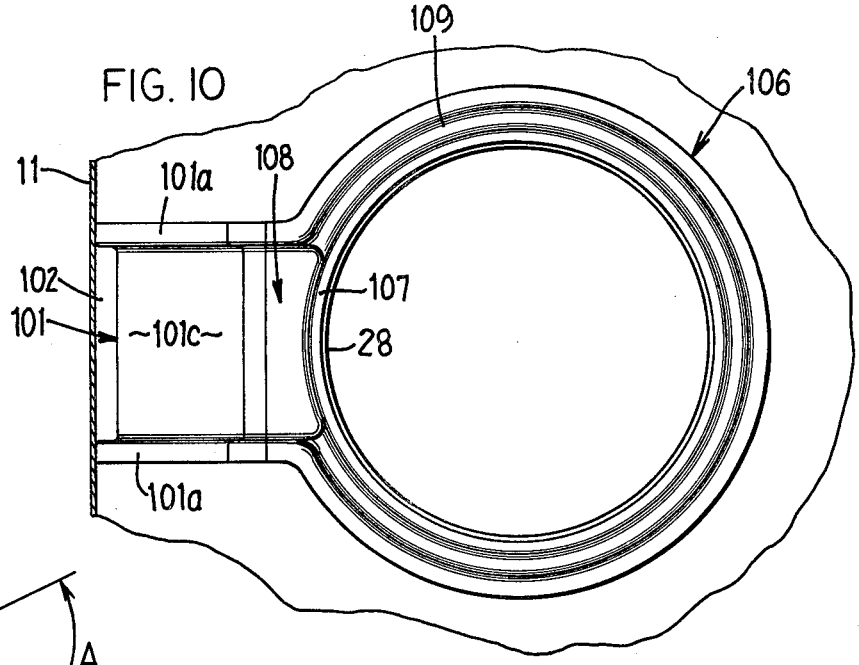
FIG. 12
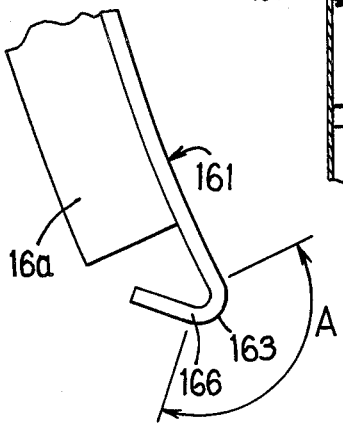
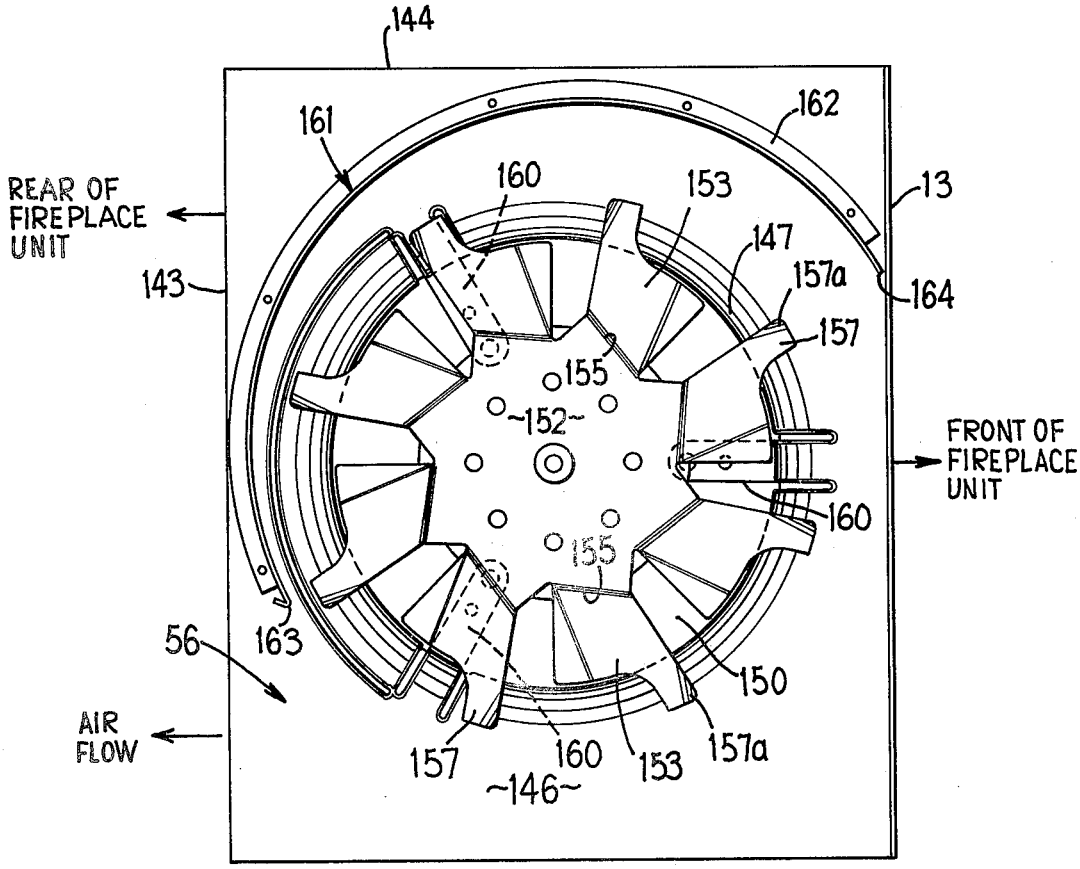
FIG. 11

FAN UNIT

CROSS-REFERENCE TO RELATED APPLICATION

This application is a continuation-in-part of my copending application Ser. No. 138,811, filed Apr. 9, 1980, now abandoned.

This invention relates to an improved fan unit. The fan unit is particularly adapted to be used for moving air through a fireplace unit useful as an efficient heat source for a living space, such as a home.

For purposes of convenience in description, the fan unit, according to the invention, will be described with reference to a fireplace unit in which the fan unit is installed. It will be understood, however, that the fan unit can be used in other environments.

The fireplace unit, incorporating the fan unit according to the invention, can be used in new construction, in lieu of a masonry fireplace, by placing the fireplace unit in an appropriately shaped opening in a building wall. Also, the fireplace unit, incorporating the fan unit according to the invention, can be used as a fireplace conversion unit for converting a pre-existing masonry fireplace into a more efficient heat source. Further, by equipping the fireplace unit with an outer cabinet and a pedestal, if needed, the unit can be used as a freestanding stove.

The following description will proceed primarily with reference to the use of the fireplace unit as a conversion unit for an existing open fireplace. However, it is to be understood that the fireplace unit according to the invention can also be used in new construction, instead of building a masonry fireplace, or it can be used as a freestanding stove, as noted above.

It is well known that conventional residential open fireplaces are not efficient heat sources and, in fact, most of them are responsible for extensive heat loss because they allow warm room air to escape up the chimney. A wide variety of structures have been suggested to overcome this disadvantage. One of the known devices is a conversion unit which can be inserted into an existing fireplace so as to close off the open front side thereof. The conversion unit includes structure effective to draw in relatively cool floor level air, circulate it upwardly around a fire box so that it becomes heated and then return the heated air to the room through a grille or grilles located at the top of the conversion unit. The conversion unit is a heavy steel shell designed to fit inside the existing fireplace and carrying closure panel means for engaging the building wall around the perimeter of the existing fireplace opening therein. Walls defining a fire box are provided inside of and spaced from the shell. The space between the fire box and the shell defines the air flow passage. The fire box has an exhaust conduit extending upwardly therefrom and through the shell for communication with the flue of the fireplace. A damper is provided in association with that exhaust conduit. The front of the fire box is normally closed by openable doors, usually made of tempered glass. A fan can be provided to effect forced circulation of air through the air flow passage.

The heat efficiency of the aforementioned type of fireplace conversion unit is vitally related to the volumetric flow rate of the air that is circulated through the air flow passage. The fans used to increase the air flow rate in the prior art conversion units have not been completely satisfactory for a variety of reasons. Many of them are too noisy. Others are incapable of achieving sufficient air flow rates to achieve maximum heat recovery. Others have required too much space so that the fireplace conversion unit was too bulky or the fan had to be located outside the fireplace unit.

Accordingly, it is an object of this invention to provide an improved fan unit for quietly circulating a large volume of air in an air flow passage, for example, to increase the heat recovery in a fireplace unit.

It is a further object of the invention to provide an improved fan unit which can be positioned horizontally underneath and in close proximity to a wall and which is effective to efficiently draw in air axially from below the fan unit and circulate it at a high volumetric flow rate in a horizontal direction radially from the fan unit and substantially parallel with the wall.

It is a further object of the invention to provide an improved fan unit, as aforesaid, in which the fan unit comprises specially shaped impeller blades and baffling in order to maximize air flow while at the same time occupying a minimum amount of space, thereby making it possible to locate the fan unit in the small space, for example, underneath the fire box of a fireplace unit.

It is another object of the invention to provide an improved fan unit, as aforesaid, which is of small axial dimension and is effective to change the direction of the air flow from axial flow at the inlet to flow in a direction normal to the axis of rotation of the fan unit at the outlet thereof so as to minimize static pressure in the region of the fan outlet whereby to increase the air flow rate.

It is another object of the invention to provide an improved fan unit, as aforesaid, which is provided with a diffuser enveloping a portion of the periphery of the impeller of the fan at the outlet side thereof so that the air discharged from the impeller is directed to flow substantially in one direction normal to the axis of rotation of the impeller.

It is another object of the invention to provide a fireplace unit including means to flow outside air or room air into the flue to dilute the flue gas whereby to cause greater gas flow out of the chimney, thereby to decrease the residence time of flue gas in the chimney, to decrease deposit of creosote in the chimney and to reduce the temperature of the gas flowing through the chimney.

Other objects and advantages of the invention will become apparent from a reading of the following description of a preferred embodiment of the invention, taken in conjunction with the accompanying drawings.

BRIEF DESCRIPTION OF THE DRAWINGS

FIG. 8 is a view, corresponding to FIG. 2, and illustrating a third modification of the invention.

FIG. 9 is a view of a fragment of FIG. 8, on an enlarged scale.

FIG. 10 is a sectional view taken along the line X—X of FIG. 8.

FIG. 11 is a view, corresponding to FIG. 3 and showing the fan unit and diffuser of the third embodiment of the invention.

FIG. 12 is an enlarged view of a fragment of the diffuser.

DESCRIPTION OF THE PREFERRED EMBODIMENT

Figure 1:
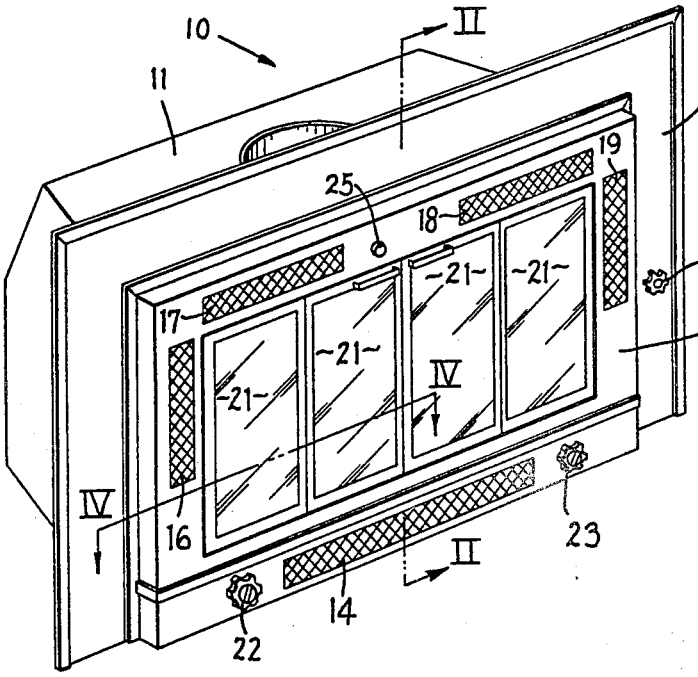
FIG. 1 is a perspective view of an embodiment of the fireplace unit incorporating the fan unit according to the invention.

Referring to FIGS. 1 to 5 of the drawings, the fireplace unit 10 comprises an outer shell 11 having a size and shape such that it can be inserted into an existing fireplace opening in a living space, such as a home, or into an appropriately shaped opening in a building wall, in the case of new construction. In most instances, existing fireplaces are tapered from front to rear and, also, the upper end of the real wall thereof slants forwardly in the upward direction. The outer shell 11 is correspondingly shaped in the illustrated embodiment of the invention. A closure panel 12 surrounds the sides and upper end of the shell 11 close to the forward end thereof. The closure panel 12 projects laterally outwardly from the shell 11 and it is adapted to engage the building wall around the sides and top of the fireplace opening therein, whereby the fireplace opening is substantially completely closed off by the fireplace conversion unit. A variety of different closure panels can be used so that the facade of the unit can match the decor of the room in which the unit is installed.

The shell 11 is here shown as projecting forwardly from the closure panel 12 a short distance. However, the front wall of the shell 11 can be flush with the closure panel 12, if desired. The shell 11 has a front wall 13 which has a centrally located air inlet opening 14 covered by a grille adjacent to its lower end. Heated air outlet openings 16, 17, 18 and 19, covered by grilles, are provided along the upper edge and at the upper ends of the side edges of the front wall 13. In some embodiments of the invention, the outlet openings 16 and 19 at the upper ends of the side edges of the front wall are omitted. The central portion of the front wall defines an opening which is closable by glass doors 21. The glass doors 21 are mounted for hinging movement between open and closed positions in any conventional manner. It is preferred to use Vycor glass (fused quartz silica glass) for the doors 21 for resistance to thermally induced shattering. Operating knobs 22 and 23 are provided adjacent the lower edge of the front wall for controlling the supply of combustion air to the fire box. Also, a control knob 24 for controlling operation of the fan, to be described hereinbelow, is mounted on the closure panel 12. A knob 25 for operating the damper is mounted on the front wall 13 adjacent to the upper edge thereof.

An inner shell 26, defining a fire box, is disposed inside the outer shell 11. The inner shell 26 has a shape substantially corresponding to the shape of the outer shell, but it is of smaller dimensions horizontally and vertically so as to define an air flow passage 27 between the two shells. Thus, the bottom, side, back and top walls of the inner shell 26 are inwardly spaced from the corresponding walls of the outer shell. The air flow passage 27 substantially completely surrounds the inner shell 26, except for the open front side thereof. The front wall 13 closes the air flow passage 27 at the front end thereof, except for the air inlet and outlet openings described above.

An upright conduit 28 extends between and penetrates through the upper walls of the inner and outer shells 11 and 26 at vertically aligned locations thereon directly above the location of the grate. The conduit 28 is adapted to communicate with the flue of the building for discharging te gaseous products of combustion from the fire box. A damper 38 is provided in the conduit 28 to control air flow therethrough. A baffle 29 is mounted inside the inner shell 26 and is located vertically downwardly spaced from and directly below the lower end of the conduit 28. As is well known, when the fire is burning, the baffle 29 retards discharging of the gaseous products of combustion from the fire box whereby to improve the heat recovery from the fireplace unit. The baffle 29 can be made of stainless steel for maximum useful life.

Fins 31 extend from the external surface of the back wall of the inner shell 26 partway toward the outer shell 11 to increase the external heat transfer area of the inner shell. The fins 31 extend substantially vertically so as not substantially to obstruct the air flow. For example, the fins 31 can be defined by substantially U-shaped members whose bases are secured to the back wall of the inner shell 26 and whose legs extend perpendicularly to the back wall of the inner shell 26. Horizontal fins 32 are mounted on the outer surface of the conduit 28 between the inner and outer shells, for the same purpose. The fins 32 can be made of steel, but it is preferred to make the fins 32 of copper to increase the heat recovery of the fireplace unit.

The portion of the air flow passage 27 located between the upper walls of the inner shell 26 and the outer shell 11 communicates with the upper heated air outlet openings 17 and 18 which are covered by grilles. The portions of the air flow passage 27 located between the side walls of the inner shell 26 and the outer shell 11, on the respective opposite sides thereof, communicate with the side heated air outlet openings 16 and 19 which are covered by grilles. When the heated air outlet openings 16 and 19 are omitted, the air that flows around the side walls of the fire box escapes through the openings 17 and 18.

A grate 33 is mounted inside the inner shell 26 adjacent to the bottom wall thereof and substantially directly below the conduit 28. The grate is here shown as being comprised of a plurality of tubes 34 which extend from front to rear and have air discharge openings 35 therethrough. The tubes 34 preferably are made of stainless steel for maximum useful life. The rear ends of the tubes 34 are supported by legs 36 and the front ends of the tubes are supported by a manifold 37 which is supported by hollow legs 38. The manner by which combustion air is supplied to the legs 38 will be described hereinbelow.

A protective screen 41, made of metal mesh may be hung inside the inner shell 26 adjacent to the front side thereof to prevent sparks from entering the living space when the doors are open.

Figure 2:
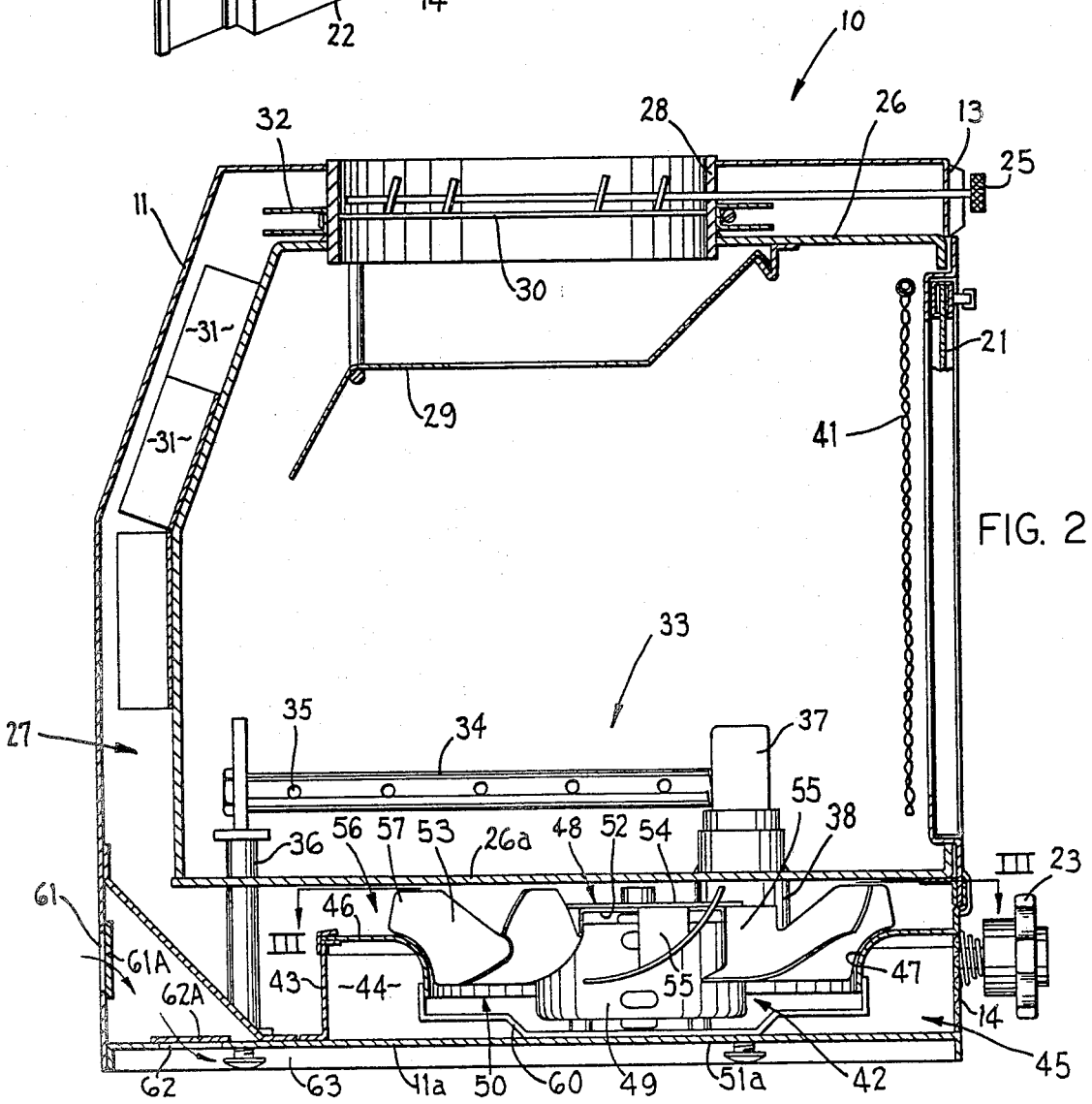
FIG. 2 is a sectional view taken along the line II—II in FIG. 1.

In the space between the bottom wall 26*a* of the inner shell and the bottom wall 11*a* of the outer shell 11, there is provided a fan unit 42 which is centrally located behind the air inlet opening 14. The fan unit 42 comprises an inlet housing 45 defined by a rear wall 43 and two side walls, one of which is shown at 44. The two side walls extend to the front wall 13 of the outer shell 11 on opposite sides of the opening 14. The bottom of the inlet housing is closed by the bottom wall 11*a* of the outer shell 11. The inlet housing is open at the front side thereof to receive air from the air inlet opening 14. The inlet housing has a top wall 46 having a circular central opening 50. The edge of the central opening 50 in the top wall 46 is curved downwardly in an arcuate shape as shown in FIG. 2 whereby to define an upwardly extending, smoothly flaring, inlet cone or shroud 47. A direct drive, air-moving impeller 48 is positioned in vertical alignment with and its lower end extends into the inlet shroud 47. The electric motor 49 for driving the impeller 48 is supported on a mounting bracket 60 by means including vibration dampers 51*a*. The bracket 60 extends diametrically across the shroud 47 and the ends of said bracket are affixed to said shroud. The impeller 48 comprises an annular back plate 52 having fan blades 53 mounted thereon at equal circumferentially spaced intervals. It is preferred to make from a single sheet of material, a one-piece assembly of the back plate 52 and the fan blades 53 wherein the blades are made by die forming to obtain a precision balanced impeller. The stiffening plate 54 is secured to the upper side of back plate 52, for example, by rivets. The stiffening plate 54 can be omitted and stiffening can be provided by ribs on the back plate 52, if desired.

Figure 3:
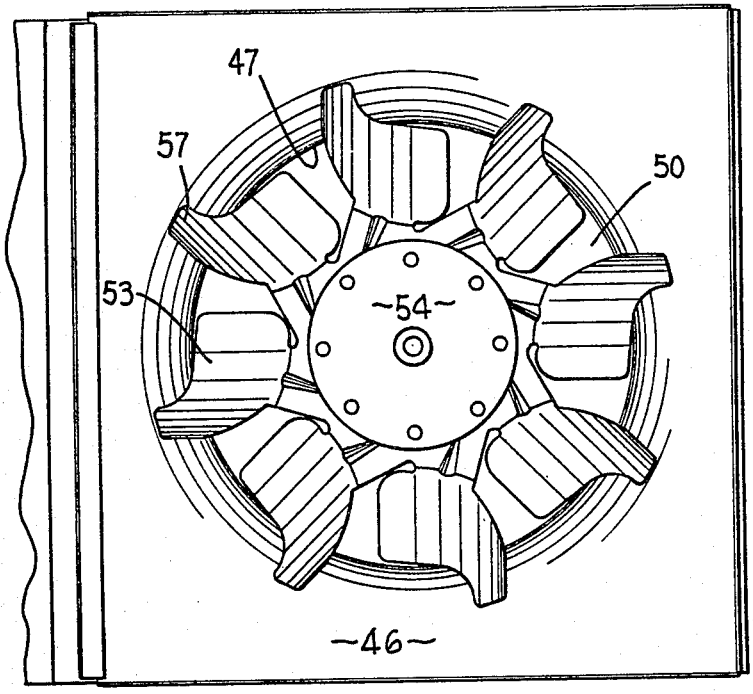
FIG. 3 is a top plan view of the impeller and associated structure of the fan unit taken along the line III—III in FIG. 2.
Figure 4:
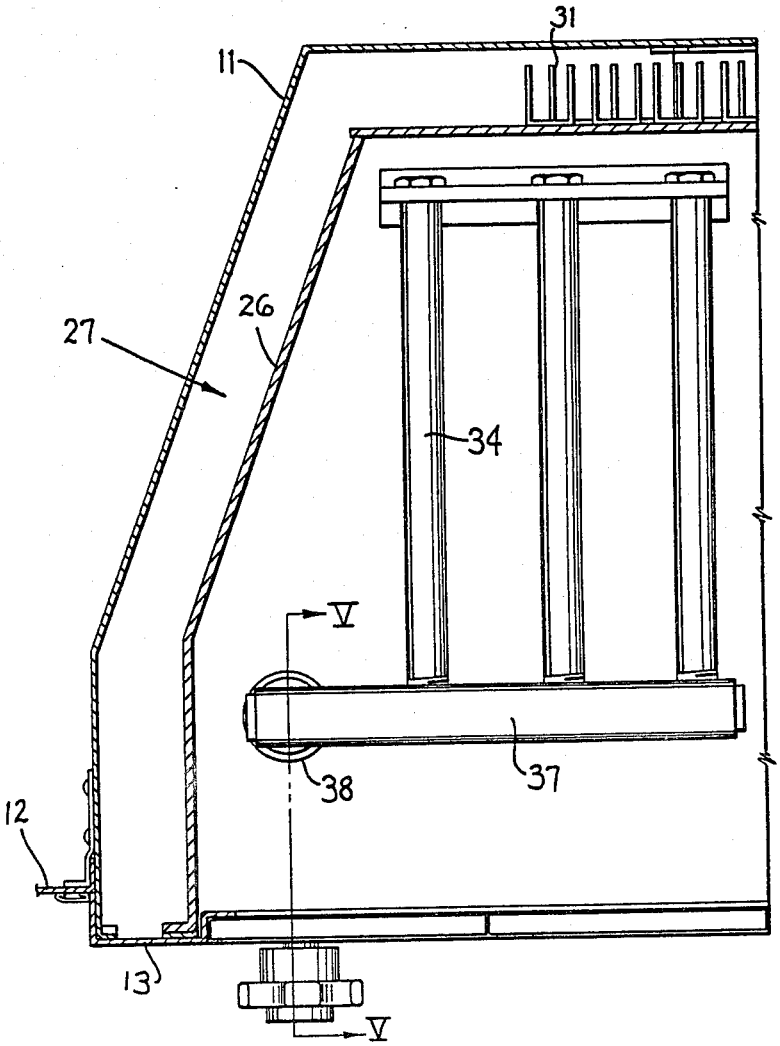
FIG. 4 is a horizontal half-sectional view of a portion of the fireplace unit taken along the line IV—IV in FIG. 1, the other half of the fireplace unit being symmetrical therewith.

The fan blades 53 are joined to the perimeter of the back plate 52 by downwardly extending legs 55. It will be noted that the legs 55 extend alongside and substantially parallel with the motor 49, whereby the motor is partially received within the central zone of the impeller to provide a compact unit. Each of the fan blades 53 is elongated and it extends laterally outwardly from the lower end of its associated leg 55. As most clearly shown in FIG. 2, in side view the blades 53 are arcuate and they are smoothly curved upwardly in a direction toward the top and front of the fireplace unit. The lower portions of the radially outer edges of the fan blades 53 are curved so as to substantially conform to the curvature of the inlet shroud 47. Thus the lower portions of the fan blades 53 fit within and are rotatable within the inlet shroud 47 over substantially the entire vertical extent thereof. As appearing in FIG. 2, the fan blades move from the front toward the rear of the fireplace unit 10 so that they pick up and impel the air toward the space 56 between the wall 46 and the wall 26*a*. As best shown in FIG. 3, at the upper and outer end of each fan blade, there is provided an outwardly extending fan blade extension section 57 which extends over the upper portion of the inlet shroud 47 and into the space 56 between the bottom wall 26*a* of the inner shell and the top wall 46 of the inlet housing, which latter space 56 defines the outlet of the fan unit. The outer edge of the fan blade extension section 57 extends substantially vertically, when viewed in side (plan) view and said extension section extends upwardly to a position close to the lower surface of wall 26*a*. It will be noted that the fan blade extension section 57 has the same curvature as the remainder of the fan blade when viewed from the radially outer end thereof.

It will be noted that the fan unit 42 comprising the bracket 60, the motor 49, the fan blades and the top wall 46 forms an integral unit which can be removed for servicing, when needed.

Thus, the lower portions of fan blades 53 impel the air to the outer fan blade extension sections 57 and the latter impel the air more or less centrifugally into the space 56. Thus, air under positive pressure becomes present in the space 56. The air impelled into space 56 travels through the air flow passage 27 and becomes heated, and then the heated air is discharged back into the living space through the openings 16, 17, 18 and 19. The incoming air flows around the motor 49 whereby to cool same.

Outside air or room air can be supplied to the fire box in a variety of ways for combustion of the fuel therein. Outside air can be supplied in the following way. An opening 61 (FIG. 2), adapted for communication with the outside air, is provided in the lower portion of the rear wall of the shell 11. The outside air flows through a hole 62 in the bottom wall 11*a* and through the passage 63 below said bottom wall to the front of the fireplace unit. Another hole 64 (FIG. 5) is provided in the bottom wall 11*a* close to each of the legs 38 so that the outside air can flow into the compartment 66. The valve 39 controls flow of outside air into the leg 38 from the compartment 66 via the hole 67. When outside air is not used for combustion, the holes 61, 62 and 64 are closed by knock-out plates 61A, 62A and 64A, respectively. Room air can be supplied through an opening 65 in the front wall 13, which opening is covered by a grille and is located behind the knobs 22 and 23. When outside air is used for combustion, the opening 65 is covered by a removable plate 70.

Another hole 68 is provided in the leg 38. The hole 68 communicates with the space 56 which receives pressurized air from the fan. A spring plate 69 covers the hole 68. The knob 22 includes an inner section 71 which is independently rotatable relative to the outer section thereof. An actuating rod 72 is affixed to the inner section 71 for rotation therewith. The rod 72 is threadedly engaged with internal threads of the rod 73 for actuating the valve 39 whereby rod 72 can be moved axially relative to rod 73. The inner end of rod 72 is connected to the central portion of spring plate 60 whereby axial movement of rod 72 is effective to bend said spring plate whereby to open or close the opening 68. When the opening 68 is open, pressurized air from space 56 flows into the leg 38 and thence through the tubes 34 and opening 35 to create forced draft conditions in the fuel on the grate. This is effective to permit ignition and burning of relatively difficult-to-ignite fuels, such as coal. Thus, both outside air and forced draft room air, or room air and forced draft room air, can be supplied to the grate, as air for combustion, according to need.

Of course, if desired, combustion air can be supplied by opening the doors 21.

Figure 6:
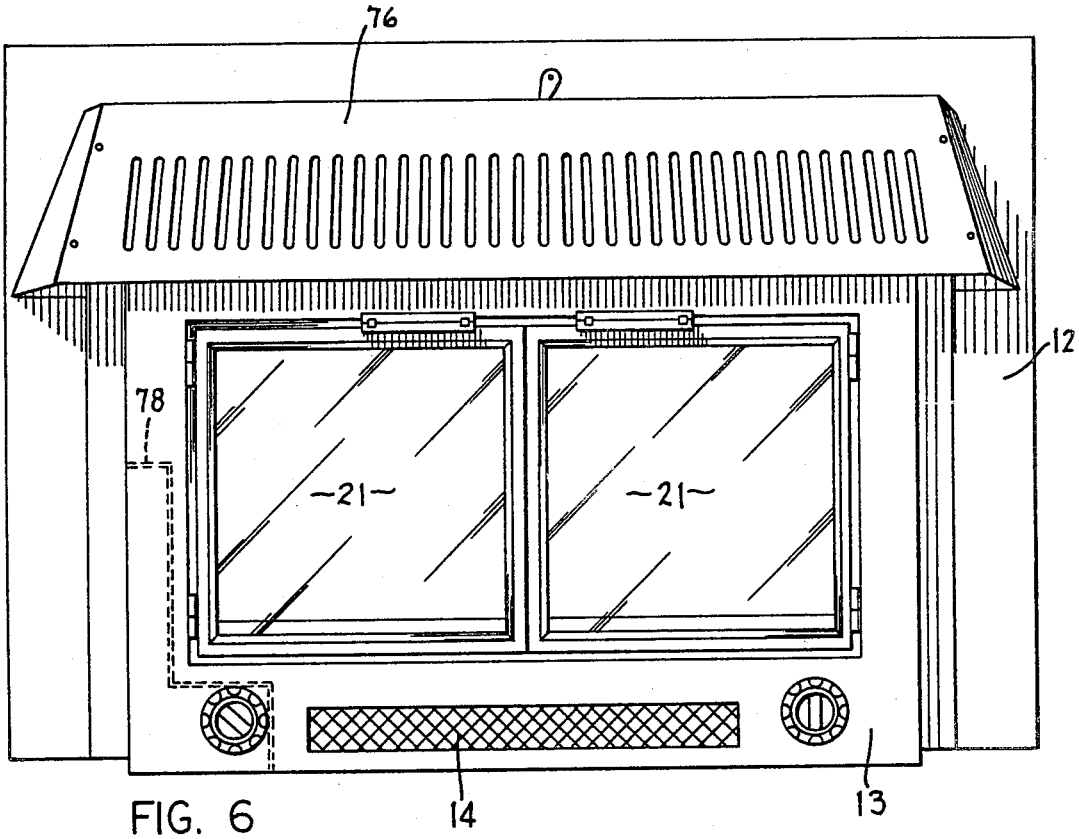
FIG. 6 is a front view of a modified fireplace unit.
Figure 7:
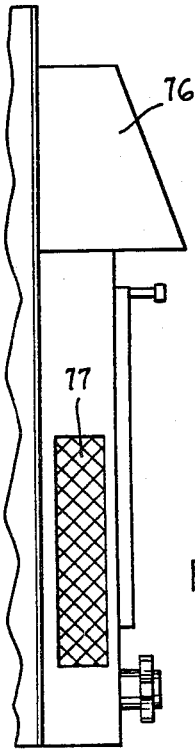
FIG. 7 is a side view of the front portion of the modified fireplace unit of FIG. 6.
Figure 5:
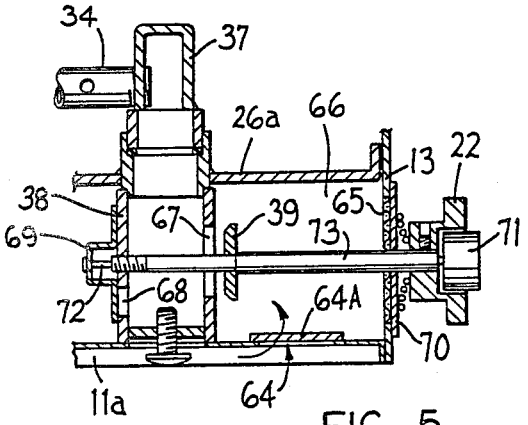
FIG. 5 is a sectional view taken along the line V—V in FIG. 4.

FIGS. 6 and 7 show an alternate fireplace unit design in which the openings 16 and 19 are omitted and a decorative hood 76 extends in front of the openings 17 and 18. These figures show an alternate room air supply for combustion. Openings 77 covered by grilles are provided in the side walls of the unit adjacent the forward edges thereof. An internal baffle 78 directs air therefrom into the compartment 66. The openings 77 can be covered by removable plates when room air is not used for combustion.

FIGS. 8 through 12 show another embodiment of the invention which incorporates a number of modifications that improve the performance. Because many of the structural features of this embodiment are the same as in the previously described embodiment, a description thereof will be omitted as being unnecessary and the following description will be directed toward the features which are different from the previously described embodiment.

Referring to FIGS. 8, 9 and 10, the fireplace unit is provided with structure for mixing outside air or room air with the flue gas that flows upwardly through the conduit 28 into the chimney. The outside air or room air is effective to dilute the flue gas that flows upwardly through the conduit 28 and it reduces the temperature of the flue gas. There is a greater rate of flow of gas through the chimney which decreases the residence time of the gas in the chimney and reduces the rate of depositing creosote on the chimney wall. Further, the temperature of the gas that flows upwardly through the chimney is reduced. This structure is comprised of an upright, shallow, channel-shaped baffle 101 which is disposed in the air flow passage 27 adjacent to the back wall of the outer shell 11 and defines a passage 102 for upward flow of outside air or room air. The legs 101*a* of the baffle are affixed to the back wall of the outer shell 11 and the base wall 101*c* of the baffle is parallel therewith. The lower end of the passage 102 communicates with the zone underneath the bottom wall 11*a* of the outer shell. The lower end of the passage 102 can be closed if it is desired not to supply room air to the passage 102. An opening 103 in the back wall of the shell 11 communicates with the passage 102 and is adapted to be connected by a conduit 104 to outside air. The opening 103 can be closed by a knockout plate (not shown) when it is not possible to connect said opening to outside air. Thus, when the knockout plate is removed and the opening 103 is connected to outside air, such outside air will be free to enter and flow upwardly through the passage 102. When the opening 103 is closed, then room air can be flowed upwardly through the passage 102. It is preferred to connect passage 102 to outside air in order to minimize loss of heated room air from the building.

The baffle 101 extends to the top wall of the casing 11 and to a location adjacent to and rearwardly of the conduit 28. An annular manifold plate 106 encircles the conduit 28 and has a lip 107 which rests on, and is continuously welded to, the upper end of said conduit. The manifold plate 107 has an opening 108 in its rearward side which opening communicates with the upper end of passage 102 so that air flowing upwardly through said passage flows into the annular groove 109 in said manifold plate. The upper side of the manifold plate 106 is covered by a top plate 111 which is spaced a predetermined short distance upwardly from the lip 107 so as to form an annular nozzle 112 of converging cross-section which communicates with the conduit 28 above the upper edge thereof. The hot flue gas that flows upwardly through the conduit 28 into the chimney draws outside air or room air through the passage 102, into the annular groove 109, from whence it flows in the form of an annular stream through the nozzle 112 into the chimney (not shown).

The fan unit 142 comprises an inlet housing 145 having a rear wall 143 and two side walls, one of which is shown at 144, like the previously described embodiment. The bottom of the fan unit is closed by the bottom wall 11*a* of the shell. The inlet housing 145 has a top wall 146 having a circular central opening 150. The inner portion of the top wall 146 is curved downwardly in an arcuate shape as shown in FIG. 8 whereby to define an upwardly extending, smoothly flaring, inlet cone or shroud 147 having a downwardly flaring lower edge 147*a*. The shroud 147 has substantially the shape of an inner portion of a torus. The top wall is a one-piece stamping which has three integral circumferentially spaced, inwardly extending ears 160 on which the motor 149 is mounted.

A direct drive, air-moving impeller 148 is positioned in vertical alignment with and its lower end extends into the shroud 147. The impeller 148 is driven by the motor 149. The impeller 148 comprises a back plate 152 having fan blades 153 mounted thereon at equal circumferentially spaced intervals. It is preferred to make from a single sheet of material, a one-piece assembly of the back plate 152 and the fan blades 153 wherein the blades are made by die forming to obtain a precision balanced impeller. The stiffening plate 154 is secured to the upper side of back plate 152, for example, by rivets. The stiffening plate 154 can be omitted and stiffening can be provided by ribs on the back plate 152, if desired.

The fan blades 153 are joined to the perimeter of the back plate 152 by downwardly extending legs 155. It will be noted that the legs 155 extend downwardly alongside and at a small angle of about 5° or so with respect to the vertical axis of the motor 49, whereby the motor is partially received within the central zone of the impeller to provide a compact unit and to cause air to be drawn around and through the openings in the motor housing to cool the motor. Each of the fan blades 153 is elongated and it extends laterally outwardly from the lower end of its associated leg 155. In side view the blades 153 are arcuate and they are smoothly curved upwardly in a direction toward the top and front of the fireplace unit. The lower portions of the radially outer edges of the fan blades 153 are curved so as to substantially conform to the curvature of the inlet shroud 147. Thus the lower portions of the fan blades 153 fit within and are rotatable within the inlet shroud 147 over substantially the entire vertical extent thereof. The fan blades move from the front toward the rear of the fireplace unit (from right to left in FIG. 8 and clockwise in FIG. 11) so that they pick up and impel the air toward the space 56 between the wall 146 and the wall 26*a*. At the upper and outer end of each fan blade, there is provided an outwardly extending fan blade extension section 157 which extends over the upper portion of the inlet shroud 147 and into the space 56 between the bottom wall 26*a* of the inner shell and the top wall 146 of the inlet housing, which latter space 56 defines the outlet of the fan unit. The outer edge of the fan blade extension section 157 extends substantially vertically, when viewed from the side, and said extension section extends upwardly to a position close to the lower surface of wall 26*a*. It will be noted that the fan blade extension section 157 has the same curvature as the remainder of the fan blade. The tip 157*a* of the extension section 157 of the fan blade is rearwardly curved relative to the direction of rotation of the impeller.

It will be noted that the fan unit 142 comprising the motor 149, the fan blades and the top wall 146 forms an integral unit which can be removed for servicing, when needed.

The portion of the impeller 148 above the top wall 146 is partially surrounded by a curved baffle or diffuser 161. The diffuser 161 is a curved sheet of L-shaped cross-section. The diffuser 161 stands upright on the top wall 146 and is secured thereto, preferably by means of spot welding through an outwardly extending flange 162 of the diffuser 161, which flange is flush with the top wall 146. The diffuser 161 preferably defines an angle of approximately 180° relative to the fan shaft center line of the fan unit 142. The diffuser 161 is shown as being a curve of constant radius, the center of which is laterally offset from the fan shaft center line so as to define a progressively enlarged zone outside the periphery of the impeller 148 from the back toward the front of the fireplace unit as appearing in FIG. 11. The diffuser 161 is close to the shape of a logarithmic spiral relative to the fan shaft center line and it provides substantial constancy of air circulation.

The leading edge 163 of the diffuser 161, relative to the air flow, is located between the fan shaft center line of the fan unit 142 and the back wall 43 as shown in FIG. 11. The leading edge 163 of the diffuser 161 extends a short distance into the outlet opening 56, so that it functions as a cutoff to facilitate transition of the somewhat spiral flow of air around the perimeter of the fan blade extension sections 157 to straight line flow out through the outlet opening 56. The diffuser 161 comprises a curved sheet that extends from its rearwardmost edge 163 circumferentially around the fan blades 153 in the direction of rotation of the fan blades, such that the distance between the diffuser 161 and the radially outer edges of the fan blades 153 continuously increases in the direction of rotation of the fan blades, thereby providing increased space for the increased volume of air impelled by the fan blades at successively advanced positions along the length of the diffuser. As shown in FIG. 11, the impeller 148 rotates clockwise and the diffuser is spaced a progressively increasing distance from the perimeter of the impeller in a clockwise direction.

The trailing edge 164 of the diffuser 161 is located forwardly of the fan shaft center line of the fan unit 42 and adjacent to an upright front wall 13, as shown in FIG. 11. The upper edge of the diffuser 161 is preferably aligned coplanar with the uppermost edges of the blade extension sections 157, leaving a small space between the upper edge of the diffuser 161 and the bottom wall **26*a*** of the inner shell to facilitate removal of the entire fan unit for servicing via the front of the fireplace unit.

As shown in FIG. 10, the leading edge 163 of the diffuser 161 is preferably provided with a radially outwardly, forwardly extending hook section 166 as is conventional for cutoff sheets for centrifugal fans. The angle A defined by the hook section 166 is preferably approximately 135°.

This embodiment of the invention employs a conventional grate made of U-shaped steel bars 171. The bottom wall **26*a* of the inner shell supports a refractory lining. The combustion air is supplied through the hollow leg 38, the manifold 37** being omitted in this embodiment.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A fan unit adapted to be disposed in an air flow passage, said fan unit comprising an inlet housing communicating with air supply means, said inlet housing comprising an upper wall and a bottom wall, said air flow passage including a space above said upper wall of said housing, said upper wall having an annular air inlet shroud extending downwardly therefrom partway to said bottom wall of said housing, said shroud having an upper end, a lower end and an arcuate, smoothly upwardly flaring, inner surface extending from said lower end to said upper end so that the inner diameter of said shroud progressively increases in a direction toward said upper end thereof, said upper end of said shroud defining a circular toroidal air outlet opening of said inlet housing; a direct drive rotatable impeller disposed coaxial with said shroud, said impeller being rotatable about a vertical axis and having a series of corresponding, circumferentially spaced-apart blades, said blades each including a lower portion and an upper portion, said lower portion extending downwardly inside of said shroud and having a lower edge and a radially outer arcuate edge conforming to the arcuate, smoothly upwardly flaring shape of said inner surface of said shroud, said upper portion extending upwardly and radially outwardly from said lower portion into said space above said upper wall of said housing which space surrounds said circular air outlet of said housing, said upper portion having an upper edge and a radially outer edge, said impeller being effective to move air from said inlet housing axially upwardly through said shroud and then direct the air radially into said space above said upper wall of said inlet housing whereupon the air then flows through said air flow passage.

2. A fan unit as claimed in claim 1 including an upright electric motor located within said shroud and being radially inwardly spaced from said inner surface, said motor having an upper end projecting above said upper end of said shroud and a lower end projecting below said lower end of said shroud, and in which said impeller is made of a single piece of metal having a centrally located back plate and having said blades integral with said back plate and extending radially outwardly therefrom, said back plate being mounted on said upper end of said motor and said fan blades being located in the space between said motor and said shroud, said lower end of said motor being disposed below the lower edges of said blades and said upper edges of said blades being disposed above said upper end of said motor.

3. A fan unit as claimed in claim 2 in which said impeller comprises downwardly extending legs extending from the perimeter of said back plate to the radially inner ends of said blades.

4. A fan unit as claimed in claim 1 in which said blades are smoothly upwardly curved when viewed from the radially outer end thereof, said blades having tangentially curved blade tips at the upper edge of said upper portions thereof, said blade tips being curved rearwardly relative to the direction of rotation of said impeller.

5. A fan unit comprising an inlet housing having an upper end and a lower end, said lower end being adapted to communicate with an air inlet, said inlet housing comprising an upper wall having an annular air inlet shroud extending downwardly therefrom partway to said lower end of said inlet housing, said shroud having an upper end, a lower end and a downwardly and inwardly smoothly arcuately curved inner shroud wall extending from said upper end to said lower end and defining a downwardly converging vertical toroidal passage having a circular air inlet opening at said lower end of said shroud, said passage having an upper end defining an enlarged circular air outlet opening of said shroud; wall means defining a space above said upper wall and surrounding said circular air outlet of said shroud; a direct drive rotatable fan disposed coaxial with said downwardly converging vertical toroidal passage, said fan being rotatable about a vertical axis and having a series of corresponding, circumferentially spaced-apart, radially outwardly extending fan blades, said fan blades each including a lower portion and an upper portion, said lower portion extending downwardly in said downwardly converging vertical toroidal passage and having a radially outer arcuate edge substantially conforming to the curvature of said inner shroud wall, said upper portion extending upwardly and radially outwardly from said lower portion into said space above said upper wall of said inlet housing and surrounding said circular air outlet of said shroud; said fan being effective to move air from said inlet housing axially upwardly through said downwardly converging vertical toroidal passage and then direct the air into said space above said upper wall of said inlet housing.

6. A fan unit, comprising an enclosure including a top wall, a bottom wall, a front wall, a back section, a first side wall and a second side wall, said front wall having air inlet opening means positioned near said bottom wall, said back section comprising air outlet opening means; a fan structure disposed within said enclosure and located directly rearwardly of said air inlet opening means, said fan structure comprising an inlet housing having an upper end and a lower end, said lower end communicating with said air inlet opening means, said inlet housing comprising an upper wall located directly below and spaced downwardly from said top wall of said enclosure to provide a space therebetween, said upper wall having an annular toroidally curved air inlet shroud extending downwardly therefrom partway to said lower end of said inlet housing, said shroud being defined by a downwardly and inwardly smoothly curved inner shroud wall defining a downwardly converging vertical passage, said passage having a lower end defining a circular air inlet opening of said shroud, said passage having an upper end defining an enlarged circular air outlet opening of said shroud; a direct drive rotatable fan disposed coaxial with said downwardly converging vertical passage, said fan being rotatable about a vertical axis and having a series of corresponding, circumferentially spaced-apart, radially outwardly extending fan blades, said fan blades each including a lower portion and an upper portion, said lower portion extending downwardly in said downwardly converging vertical passage and having a radially outer edge substantially conforming to the curvature of said inner shroud wall, said upper portion extending upwardly and radially outwardly from said lower portion into said space between said upper wall of said inlet housing and said top wall of said enclosure and surrounding said circular air outlet of said inlet housing, said upper portion having an upper edge and a radially outer edge; and a curved, vertically extending diffuser mounted on said upper wall and surrounding a portion of the path of travel of said upper portions of said fan blades, said diffuser having a leading edge located near said air outlet means, said diffuser extending in a circumferential direction from said leading edge in the direction of rotation of said fan blades and being curved so that the distance between said diffuser and the radially outer edges of said upper portions of said fan blades continuously increases, said diffuser having a trailing edge located on the opposite side of said fan from said leading edge, said fan in combination with said diffuser being effective to move air from said inlet housing axially upwardly through said downwardly converging vertical passage and then direct the air into said space between said upper wall of said inlet housing and said top wall of said enclosure whereupon the air is guided by said diffuser and then flows through said air outlet opening means.

7. A fan unit as claimed in claim 6, wherein said diffuser has radially outwardly extending flange means, said flange means being secured to said upper wall of said inlet housing.

8. A fan unit as claimed in claim 6 or claim 7 in which said direct drive rotatable fan comprises an electric motor disposed within said downwardly converging vertical passage and extending upwardly through said circular air outlet opening in said shroud with the shaft of said motor being coaxial with the axis of said circular toroidal air outlet opening of said shroud, a horizontal back plate mounted on the upper end of the shaft of said motor for rotation therewith, said fan blades being mounted on the underside of said back plate for rotation therewith.

9. A fan unit as claimed in claim 6 or claim 7 in which said fan blades are smoothly upwardly curved when viewed from the radially outer end thereof, the tips of said fan blades at the upper edges of said upper portions thereof being curved rearwardly relative to the direction of rotation of said impeller.

10. A fan unit as claimed in claim 6 wherein said trailing edge of said diffuser is adjacent to said front wall.

11. A fan unit as claimed in claim 6 or claim 10, wherein said diffuser extends through an arc of approximately 180° relative to the vertical axis of said fan.

12. A fan unit as claimed in claim 11, wherein said diffuser has an upper edge, said upper edges of said fan blades lie in a common plane and said upper edge of said diffuser is coplanar with said plane, said plane being perpendicular to the vertical axis of said fan and being slightly vertically downwardly spaced from said top wall.

13. A fan unit as claimed in claim 12, wherein said leading edge of said diffuser is provided with a cut-off portion extending outwardly from the leading edge of said diffuser.

14. A fan unit as claimed in claim 11, wherein said first side wall and said second side wall define a pair of parallel planes.

15. A fan unit as claimed in claim 14, wherein said enclosure is a substantially rectangular structure.

16. A fan unit adapted to be disposed in an air flow passage, said fan unit comprising an inlet housing communicating with air supply means, said inlet housing comprising an upper wall and a bottom wall, said air flow passage including a space above said upper wall of said housing, said upper wall having an annular air inlet shroud extending downwardly therefrom partway to said bottom wall of said housing, said shroud having an upper end, a lower end and an inner surface extending from said upper end to said lower end, said upper end of said shroud defining a circular toroidal air outlet opening of said inlet housing; a direct drive rotatable impeller disposed coaxial with said shroud, said impeller being rotatable about a vertical axis and having a series of corresponding, circumferentially spaced-apart blades, said blades each including a lower portion and an upper portion, said lower portion extending downwardly inside of said shroud and having a radially outer edge conforming to the shape of said radially inner surface of said shroud, said upper portion extending upwardly and radially outwardly from said lower portion into the space above said upper wall of said housing and surrounding said circular air outlet of said housing, said upper portion having a radially outer edge, said impeller being effective to move air from said inlet housing axially upwardly through said shroud and then direct the air radially into the space above said upper wall of said inlet housing whereupon the air then flows through said air flow passage, and an upright diffuser extending upwardly from said upper wall, said diffuser encircling approximately one-half of the circumference of said upper portion of said impeller and being spaced a progressively increasing radial distance from the radially outer edges of the upper portions of the blades of said impeller from one end of said diffuser toward the other end thereof, whereby to transform the spiral flow of air from said upper portions of said blades into substantially straight line flow.

17. A fan unit comprising substantially parallel top and bottom walls defining an elongated air flow passage having an air inlet opening at one longitudinal end thereof and an air outlet opening at the opposite longitudinal end thereof, said air flow passage being substantially closed except for said inlet and outlet openings; a fan structure disposed in said air flow passage, said fan structure comprising an inlet housing having an upper wall substantially parallel with and spaced downwardly from said top wall, said upper wall being spaced upwardly from said bottom wall, said inlet housing having a side wall extending to said bottom wall, the space between said upper wall and said bottom unit communicating with said air inlet opening, said upper wall having an annular air inlet shroud extending downwardly therefrom partway to said bottom wall, said shroud having an arcuate, smoothly upwardly flaring, inner surface so that the inner diameter of said shroud progressively increases in a direction toward said top wall, the upper end of said shroud defining a circular toroidal air outlet opening of said inlet housing; a direct drive rotatable impeller disposed coaxial with said shroud, said impeller being rotatable about a vertical axis and having a series of corresponding, circumferentially spaced-apart blades, said blades each including a lower portion and an upper portion, said lower portion extending downwardly inside of said shroud and having a radially outer arcuate edge conforming to the arcuate, smoothly upwardly flaring shape of said inner toroidal surface of said shroud, said upper portion extending upwardly into close proximity to said top wall and extending radially outwardly from said lower portion into the space between said top wall and said upper wall of said housing and surrounding said circular air outlet of said housing, said impeller being effective to move air from said inlet housing axially upwardly through said shroud and then direct the air radially into the space above said upper wall of said inlet housing whereupon the air then flows through said air flow passage.

* * * * *